US005850703A

United States Patent [19]

Pearce et al.

[11] Patent Number: 5,850,703

[45] Date of Patent: Dec. 22, 1998

[54] CUSHIONED INSOLE

[75] Inventors: John G. Pearce; Charles E. Shuler, both of Fort Worth, Tex.

[73] Assignee: Boot Royalty Company, L.P., Fort Worth, Tex.

[21] Appl. No.: 898,937

[22] Filed: Jul. 23, 1997

[51] Int. Cl.[6] ..... A43B 13/38; A43B 9/10; A43B 13/18; A43D 9/00

[52] U.S. Cl. ..... 36/43; 36/16; 36/17 R; 36/19 R; 36/21; 12/142 C; 12/142 D

[58] Field of Search ..... 36/43, 44, 12, 36/16, 17 R, 18, 19 R, 17 PW, 21; 12/142 B, 142 C, 142 D, 142 T

[56] References Cited

U.S. PATENT DOCUMENTS

| | | | |
|---|---|---|---|
| 811,260 | 1/1906 | Tirrell . | |
| 1,093,032 | 4/1914 | Cadenas | 36/16 |
| 1,123,245 | 1/1915 | Chesbrough | 36/19 R |
| 1,136,799 | 4/1915 | Harris . | |
| 1,335,287 | 3/1920 | Lundin et al. | 36/16 |
| 1,458,824 | 6/1923 | Hess . | |
| 1,767,698 | 6/1930 | Pickett . | |
| 1,841,058 | 1/1932 | Rosenwasser | 36/17 R |
| 1,924,542 | 8/1933 | DeLiso | 12/142 |
| 2,011,696 | 8/1935 | Turner | 12/142 |
| 2,157,818 | 5/1939 | Disch | 36/18 |
| 2,178,629 | 11/1939 | Everston | 36/19 |
| 2,220,555 | 11/1940 | Stritter | 36/19 |
| 2,359,681 | 10/1944 | Rovick | 36/17 R |
| 2,468,617 | 4/1949 | Diamant | 12/142 C |
| 2,548,266 | 4/1951 | Katz | 36/22 |
| 2,598,296 | 5/1952 | Pierson | 36/22 |
| 2,794,996 | 6/1957 | Stritter | 12/146 |
| 3,217,345 | 11/1965 | Snitzer | 36/17 R |
| 4,001,954 | 1/1977 | Taylor, Jr. | 36/19 R |
| 5,195,255 | 3/1993 | Coughlin | 36/12 |

*Primary Examiner*—M. D. Patterson
*Attorney, Agent, or Firm*—Sidley & Austin

[57] ABSTRACT

A cushioned insole (10) has an upper layer (12) and a lower layer (14). The layers have a toe area, a heel area, an upper surface and a lower surface. The insole has a cushion (28) disposed between the lower surface of the upper layer and the upper surface of the lower layer in the toe area of the layers. In the heel area of the layers, a tack board (30) is disposed between the upper and lower layers. A rib (40) is attached to the upper surface of the upper layer and to the lower layer by stitching, capturing the cushion therebetween and forming a peripheral margin exteriorly of the stitching. A lip (32) is formed from the upturned peripheral margin of the upper layer and is attached to the rib to add strength and reinforcement to the overall structure.

30 Claims, 3 Drawing Sheets

CUSHIONED INSOLE

BACKGROUND OF THE INVENTION

1. Field of the Invention

The present invention relates to an insole for footwear, such as boots and shoes. More specifically, the present invention relates to a cushioned insole.

2. Description of the Prior Art

The prior art includes several traditional insoles. For example, U.S. Pat. No. 2,598,296 relates to an insole having a forward ball and toe portion and a shank and heel portion 1. The shank portion 1 includes a beveled forward edge 2. The forward and shank portions are connected by zigzag stitching 3. The forward portion includes an intermediate cushion layer 4 "of soft, slightly compressible, readily flexible and resilient material, preferably a highly compressed composition of cork and latex. . . ." Col. 3, 11. 41–43. An outer strengthening layer 5 consisting of a thin, light-weight, loosely woven fabric is attached over one entire surface of the intermediate cushion layer 4. An inner layer 6 of a thin, light-weight, soft leather split is secured to the opposite surface of the intermediate cushion layer 4. Thus, the outer strengthening layer 5 and the inner layer 6 do not serve to fully enclose the cushion layer 4. Moreover, the layers 5 and 6 are made of different materials. A sewing rib is secured to the outer strengthening layer 5 of the insole by an attaching portion 7. The rib also includes an upstanding portion 12. An outer line of stitching 8 and an inner line of stitching 9 secures the rib to the insole so as to compress the intermediate cushion layer 4. The rib also requires the use of a reinforcing tape 11, which is attached by cement between the upstanding portion 12 of the rib and the adjacent surface of the outer fabric layer 5. An upper 13 and welt 14 are stitched to the upstanding portion 12 by a line of stitching 15. An insert 16 consisting of a sheet of compressed composition of cork and latex is inserted into the recess formed between the exposed edges of the upper 13 and the sewing rib. The outer sole 17 is then stitched to the welt 14.

U.S. Pat. No. 2,178,629 relates to an insole 10 having a lower surface 11 which includes a lip 12. The lip 12 follows the contour of the forward half of the sole 10 and receives the thinned edges of a cushion 15. An upper 16 and the lining 17 are lasted over the margin 18 of the insole 10 and underlie the lip 12. The '629 patent also discloses that the cushion 152 can be wholly disposed within a pocket created by removing the central portion of the insole 10 completely within the lip 12 shown in FIG. 4. However, the cushion 152 would not thereby be enclosed within the pocket by an additional layer of insole.

U.S. Pat. No. 2,548,266 relates to an insole blank 10 united to a cushion blank 11 by cement 12. A welt sewing rib is connected to the cushion ply 11 using a rectangular strip 13 and an adhesive tape 14. Alternatively, an adhesive sheet 15 may be used in place of tape 14. The cushion ply is described as a "cork composition which is inherently resilient and will yield readily to compression". Col.4, 11. 31–33. Thus, in both embodiments, the rib is connected directly to the cushion ply 11.

U.S. Pat. No. 2,794,996 discloses an insole 10 having a shank-and-heel piece 12 secured thereto. Optionally, a thin flexible forepart piece 14 may be joined to the shank-and-heel piece 12 by a seam 15. A pocket piece 16 is secured to the peripheral margin of the insole 10. The pocket piece 16 is secured to the insole 10 so as to form a rearwardly open pocket which contains a temporary stiffening plate 18. A ribbed strip 36 is secured to the insole 10. The insole 10 is secured to a last L. An upper 38 is assembled upon the last L. A welt 40 is secured to the upper 38 and to the rib of the insole 10. The temporary stiffening plate 28 is then removed and a filler 44 is applied, and an outsole 46 is attached to the welt 40. A cushion filler 54 may be used in the filling cavity. This patent does not disclose the use of the filler 54 in the pocket, but rather discloses that cement is to be introduced under the pocket piece 16 before the shoe is filled. Col. 5, 11. 24–27.

These traditional insoles fail to disclose a cushioned insole which provides the desired comfort and flexibility, while providing ease of manufacture of the boot or shoe in which the insole is used. Thus, a need exists for a cushioned insole which affords the desired comfort and flexibility to the completed footwear product while providing ease of manufacture and structural integrity to the final product.

SUMMARY OF THE INVENTION

The present invention is to a cushioned insole which provides comfort and flexibility to the boot or shoe in which it is used while providing for ease of manufacture and added structural integrity. The cushioned insole includes an upper insole layer and a lower insole layer. Each of the layers includes a toe area and a heel area. The layers also include an upper surface and a lower surface. The cushioned insole includes a cushion material disposed between the lower surface of the upper layer and the upper surface of the lower layer in the toe area of the layers. In the heel area, a tack board is disposed between the lower surface of the upper layer and the upper surface of the lower insole layer. A rib is secured to the upper surface of the upper layer and defines a peripheral margin around the periphery of the upper layer. A lip is formed from the upturned peripheral margin of the toe area of the upper insole layer and is upturned against and attached to the outwardly facing surface of the rib to form a unitary structure.

DETAILED DESCRIPTION

Figure 1:
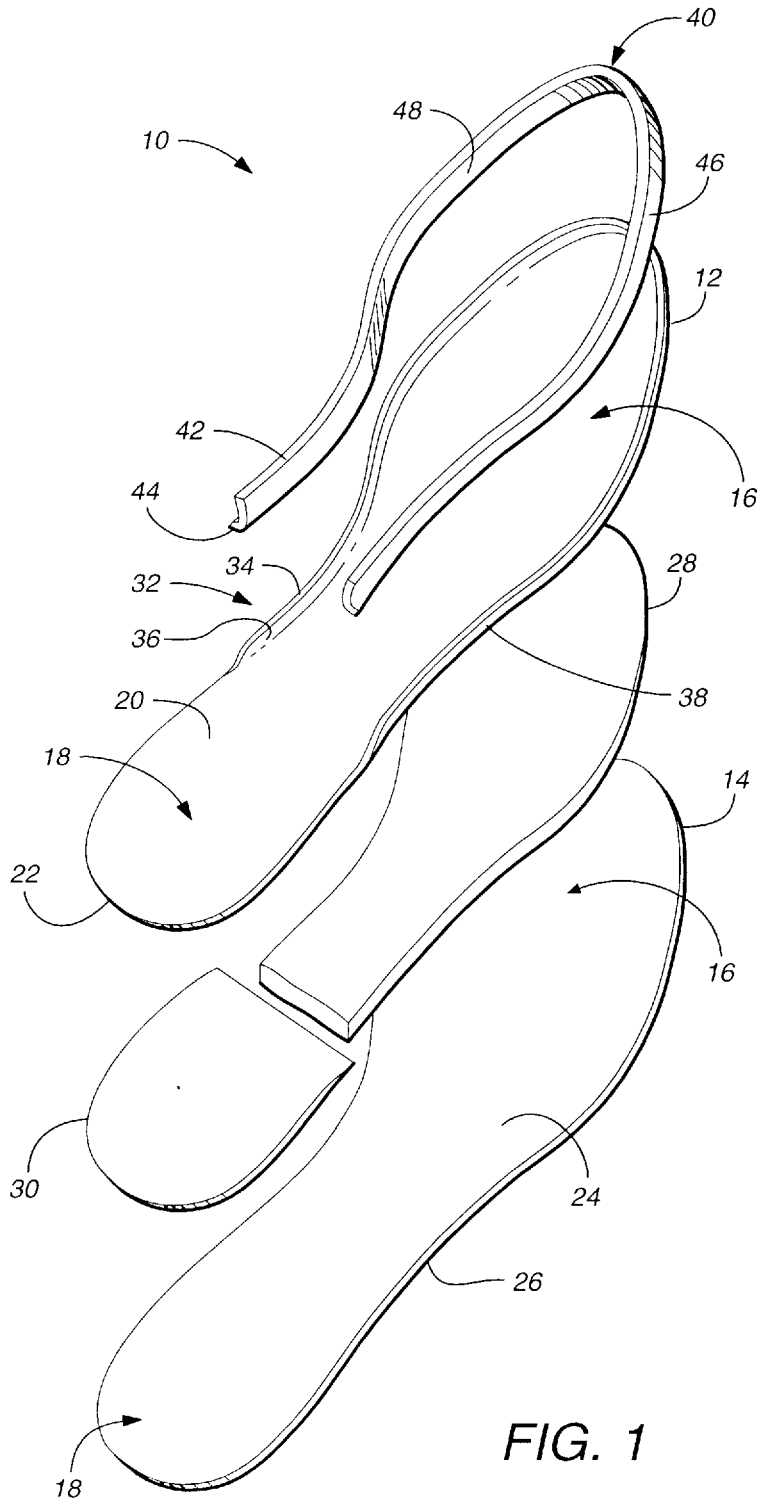
FIG. 1 is a perspective, exploded view of the cushioned insole of the present invention.

Referring to FIG. 1, the present invention is a cushioned insole 10 which includes an upper insole layer 12 and a lower insole layer 14. In the preferred embodiment, layers 12 and 14 are made of leather although they may be made from other natural or synthetic materials. Layers 12 and 14 can be shaped so as to accommodate any desired size of footwear product. A completed footwear product using the cushioned insole 10 actually reverses the orientation of the upper layer 12 and the lower layer 14 such that the upper layer 12 is disposed vertically below the lower layer 14 with respect to the ground. Nevertheless, the present "upper" and "lower" designations are employed because the layers 12 and 14 are shown in the FIGURES as oriented during the manufacture of the footwear product. Moreover, it is common in the art to reference an insole in the orientation in which it is positioned during manufacture.

Each of the layers 12 and 14 include a toe area 16 and a heel area 18. The upper layer 12 has an upper surface 20 and a lower surface 22. The lower layer 14 has an upper surface 24 and a lower surface 26. Disposed between the toe area 16 of the upper layer 12 and the toe area 16 of the lower layer 14 is a cushion 28. Specifically, cushion 28 is disposed between the toe area of the lower surface 22 of the upper layer 12 and the upper surface 24 of the lower layer 14. Cushion 28 is preferably made of an elastic, sponge-like material such as closed-cell foam. As a result, the cushion 28 is fully enclosed between the upper layer 12 and the lower layer 14. Cushion 28 allows the cushioned insole 10 to afford the desired comfort and flexibility to a completed footwear product.

Disposed between the heel area 18 of the upper surface 12 and the lower surface 14 is a tack board 30. Specifically, tack board 30 is disposed between the heel area 18 of the lower surface 22 of the upper layer 12 and the heel area 18 of the upper surface 24 of the lower layer 14. Tack board 30 permits attachments of the heel as well as other sole components to cushioned insole 10. One preferred material for the tack board 30 is recycled fibers.

Figure 3:
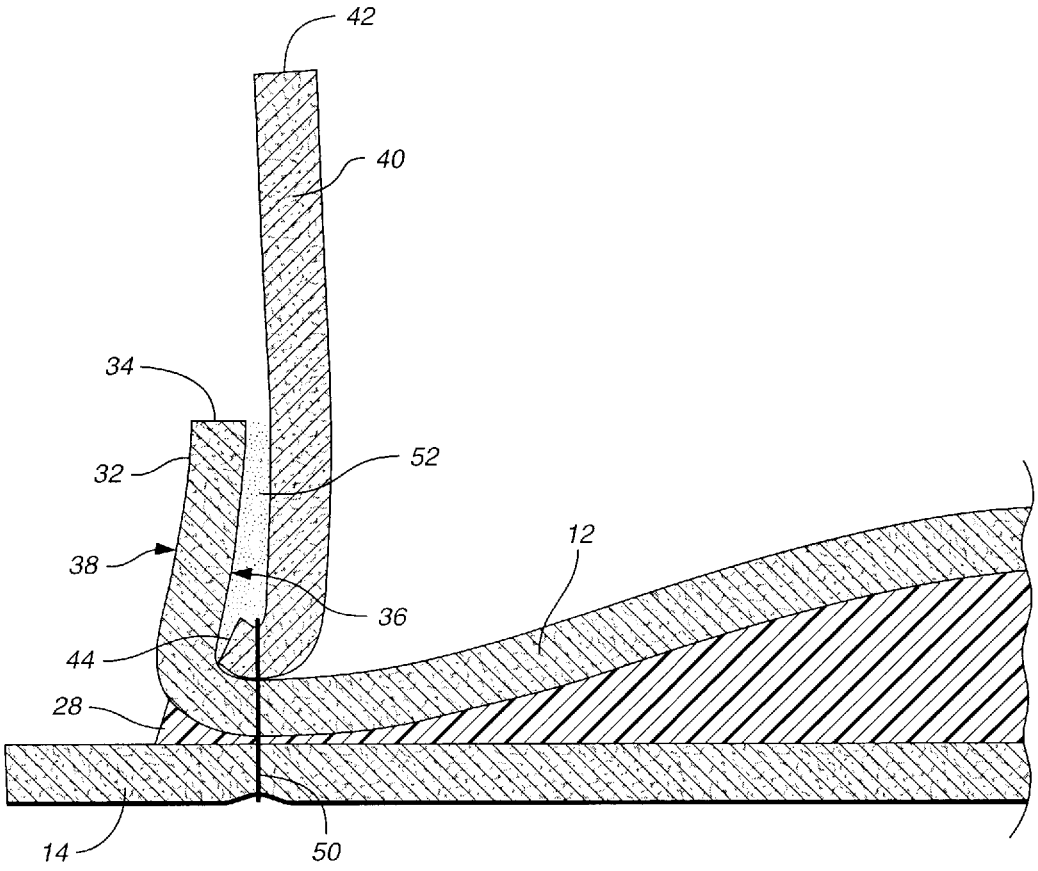
FIG. 3 is a section view taken along line 3—3 of FIG. 2.

Referring to FIG. 3 in conjunction with FIG. 1, the upper layer 12 has a lip 32 formed therefrom by upturning a peripheral margin of the toe area 16 of the upper layer 12. Thus, lip 32 is an integral portion of the upper layer 12. Lip 32 has a rim 34, an inner surface 36 and an outer surface 38. The inner surface 36 faces the toe area 16 of the upper surface 20 of the upper layer 12.

A rib 40 is secured to the upper surface 20 of the upper layer 12, preferably by stitching 50. Rib 40 includes an upper edge 42, a lower edge 44, an outer surface 46 and an inner surface 48. In the final assembly of the insole of the present invention, the outer surface 46 of the rib 40 is secured to the inner wall 36 of the lip 32. Thus, the inner surface 48 of the rib 40 faces the toe area 16 of the upper layer 12. The preferred material for rib 40 is leather. The preferred height of the rib 40, as measured from the lower edge 44 of the rib 40 to the upper edge 42 of the rib 40, is approximately ten (10) millimeters.

This completed up-standing rib 40 is the portion of cushioned insole 10 which is used to attach the boot upper to the cushioned insole. This completed structure provides a rib 40 which is reinforced by the lip 32, thereby creating significant structural integrity to the completed footwear product.

Figure 2:
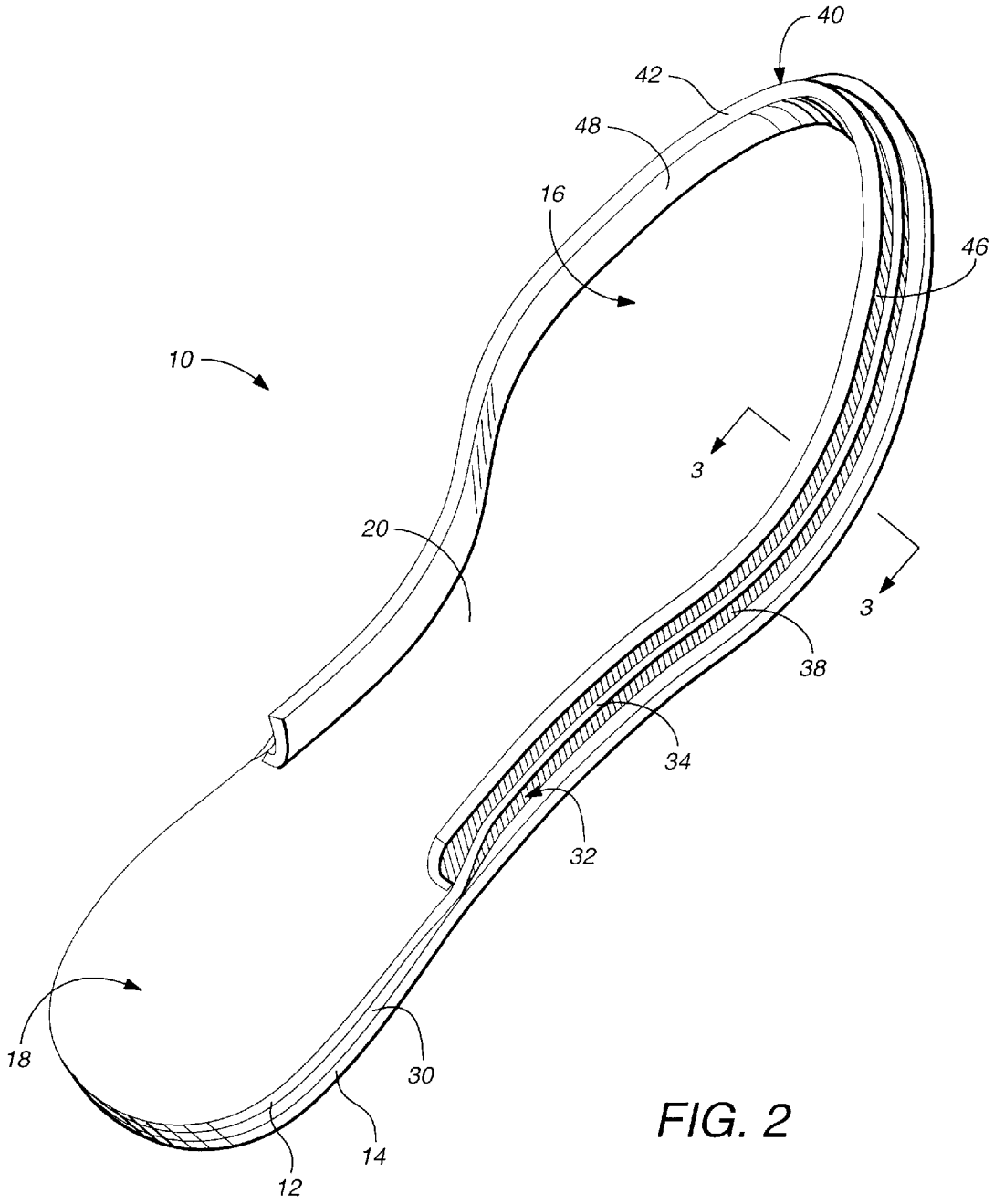
FIG. 2 is a prospective view of the assembled cushioned insole of the present invention.

FIGS. 2 and 3 show insole 10 in its fully assembled configuration. As assembled, the lower surface 22 of the upper layer 12 is largely obstructed from view. Likewise, the upper surface 24 of the lower layer 14 is largely obstructed from view. As shown, rib 40 is attached to the upper surface 20 of the upper layer 12 and to the lip 32. Also as shown, the lip 32 is the upturned portion of the peripheral margin of the toe area 16 of the upper layer 12 which is exterior of the outer surface 46 of the rib 40.

One method of manufacturing the cushion insole includes the steps of sewing rib 40, using stitching 50, to the toe area 16 of the upper surface 20 of the upper layer 12 so as to capture the cushion 28 between the lower surface 22 of the upper layer 12 and the upper surface 24 of the lower layer 14. In the stitching process, the lower edge of rib 40 is sewn to the upper and lower layers 12 and 14 with stitching passing through the rib and through layers 12 and 14 to join all three pieces of material in a single stitching operation. As a result, the toe area of the upper layer 12 is secured to the toe area 16 of the lower layer 14. The peripheral margin of the toe area 16 of the upper layer 12 which is exterior of the rib 40 is then up-turned to form the lip 32. The lip 32 is then secured to the rib 40 by adhesive 52 (FIG. 3) or other suitable means.

Thus, the present invention provides a novel cushion insole comprising a lower insole layer, a cushion layer and an upper insole layer attached to the lower layer along a boundary to form a peripheral margin exterior of the attachment of the upper layer to the lower layer. This attachment, which is accomplished preferably by stitching, captures the cushion layer between the upper layer and lower insole layer. A rib is affixed to the upper layer, preferably by the same stitching operation which attaches the upper layer to the lower layer. The rib is affixed interiorly of a peripheral margin of the upper layer defined by this attachment step. The peripheral margin of the upper layer is then upturned and is attached to the rib to provide a unitary, integral insole construction which results in improved flexibility and superior structural integrity.

Although preferred embodiments of the invention have been described in the foregoing Detailed Description and illustrated in the accompanying drawings, it will be understood that the invention is not limited to the embodiments disclosed but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

What is claimed is:

1. A cushioned insole comprising:

a lower insole layer;

a cushion layer;

an upper insole layer secured to said lower layer by stitching the upper layer to the lower layer forming a peripheral margin exteriorly of the stitching on the upper layer and capturing the cushion layer between the upper layer and lower layer; and an attachment rib affixed to the upper layer by said stitching, said peripheral margin of the upper layer being attached to the rib by being upturned thereagainst and attached thereto.

2. The cushioned insole of claim 1 wherein said upper layer and said lower layer are made of leather.

3. The cushioned insole of claim 1 wherein the height of said rib as measured from said lower edge of said rib to said upper edge of said rib is approximately ten (10) millimeters.

4. A footwear product produced using the cushioned insole of claim 1.

5. A boot produced using the cushioned insole of claim 1.

6. An insole comprising:

an upper insole layer; and a rib attached to said upper insole layer along a boundary to form a peripheral margin exteriorly of the attachment of said rib to said upper layer, said upper layer being upturned along the peripheral margin with the surface of peripheral margin being attached to said rib.

7. The insole of claim 6 wherein said rib is attached to said upper layer by stitching.

8. The cushioned insole of claim 6 wherein said peripheral margin is attached to said rib by adhesive.

9. A cushioned insole comprising:

a lower insole layer;

an upper insole layer attached to said lower layer along a boundary to form a peripheral margin exteriorly of the attachment of the upper layer to said lower layer;

a cushion layer positioned between said upper and lower layers; and a rib affixed to said upper layer, said peripheral margin of the upper layer being attached to the rib by being upturned thereagainst and attached thereto.

10. The cushioned insole of claim 9 wherein said rib is attached to the upper layer by said attachment of said upper layer to said lower layer.

11. The cushioned insole of claim 9 wherein said upper layer and said lower layer are made of leather.

12. The cushioned insole of claim 9 wherein said upper layer is secured to said lower layer by stitching.

13. The cushioned insole of claim 9 wherein said outer surface of said rib is secured to said inner wall of said lip by adhesive.

14. A cushioned insole comprising:

an upper layer having a toe area, a heel area, an upper surface and a lower surface, said upper layer having the peripheral margin of the toe area upturned to form a lip, said lip defining a rim, an inner surface and an outer surface, said inner surface of said lip facing the remainder of the toe area of the upper surface of the upper layer;

a lower layer secured to said upper layer having a toe area, a heel area, an upper surface and a lower surface, said toe area of said lower layer being disposed below said toe area of said upper layer and said heel area of said lower layer being disposed below said heel area of said upper layer;

a cushion enclosed between the toe area of the lower surface of said upper layer and the toe area of the upper surface of said lower layer;

a tack board disposed between the heel area of the lower surface of said upper layer and the heel area of the upper surface of said lower layer; and a rib having an upper edge, a lower edge, an inner surface and an outer surface, said lower edge of said rib being secured to said toe area of said upper surface of said upper layer, said outer surface of said rib being secured to said inner surface of said lip.

15. The cushioned insole of claim 14 wherein said upper layer and said lower layer are made of leather.

16. The cushioned insole of claim 14 wherein said lower and upper layers are secured by stitching.

17. The cushioned insole of claim 14 wherein said outer surface of said rib is secured to said inner surface of said lip by adhesive.

18. The cushioned insole of claim 14 wherein the height of said rib as measured from said lower edge of said rib to said upper edge of said rib is approximately ten (10) millimeters.

19. A footwear product produced using the cushioned insole of claim 14.

20. A boot produced using the cushioned insole of claim 14.

21. A method for manufacturing an insole comprising:

attaching a rib to an upper insole layer at a distance from the edge of the upper insole layer to define a peripheral margin;

upturning the peripheral margin of the upper insole layer exteriorly of the rib to form a lip; and securing the upturned lip to the rib.

22. The method of claim 21 wherein attaching the rib to the upper insole layer also attaches the upper layer to a lower insole layer and captures a cushion layer between the upper and lower layers.

23. The method of claim 21 wherein the attachment of the rib to the upper insole layer is by stitching.

24. The method of claim 21 wherein the lip is secured to the rib using adhesive.

25. A footwear product produced using the cushioned insole manufactured by the method of claim 21.

26. A boot product produced using the cushioned insole manufactured by the method of claim 21.

27. A method for manufacturing a cushioned insole comprising:

positioning a cushion layer of material between an upper insole layer and a lower insole layer;

sewing a rib to the upper and lower insole layers at a distance from the edge of the upper insole layer to define a peripheral margin and capturing the cushion layer therebetween;

upturning the peripheral margin of the upper insole layer exteriorly of the rib to form a lip; and securing an inner wall of the lip to the rib.

28. The method of claim 27 wherein the inner wall of the lip is secured to the rib using adhesive.

29. A footwear product produced using the cushioned insole manufactured by the method of claim 27.

30. A boot product produced using the cushioned insole manufactured by the method of claim 27.

* * * * *